United States Patent [19]

Brushenko

[11] 3,963,488

[45] June 15, 1976

[54] CONTRAST OF ELECTROSTATIC LATENT IMAGES WITH A LIGHT FLOODING STEP

[75] Inventor: Anatoli Brushenko, Elmhurst, Ill.

[73] Assignee: GAF Corporation, New York, N.Y.

[22] Filed: Sept. 3, 1974

[21] Appl. No.: 502,627

[52] U.S. Cl. ..... 96/1 R; 317/262 A

[51] Int. Cl.[2] ..... G03G 13/14

[58] Field of Search ..... 96/1 C, 1 TE; 317/262; 250/49.5

[56] References Cited

UNITED STATES PATENTS

| | | | |
|---|---|---|---|
| 2,825,814 | 3/1958 | Walkup | 317/262 A |
| 3,057,275 | 10/1962 | Walkup et al. | 96/1 TE |
| 3,370,212 | 2/1968 | Frank | 317/262 |

FOREIGN PATENTS OR APPLICATIONS

| | | | |
|---|---|---|---|
| 250,947 | 1/1962 | Australia | 96/1 R |
| 375,995 | 6/1962 | Japan | 96/1 C |

*Primary Examiner*—David Klein
*Assistant Examiner*—John L. Goodrow
*Attorney, Agent, or Firm*—Walter C. Kehm; Arthur Dresner

[57] ABSTRACT

A method for enhancing the contrast of a latent electrostatic image on a dielectric surface is disclosed which includes positioning a photoconductive electrode adjacent the dielectric surface; and applying an electrical potential between the photoconductive member and the dielectric surface, while irradiating selected portions of the photoconductive electrode, to cause electrical charge formation on selected portions of the dielectric surface corresponding to the selected photoconductive electrode portions. Thereafter, the applied electrical potential is reduced to essentially zero. In accordance with this invention, during such reduction to essentially zero potential, the entire surface of the photoconductive member is briefly flooded with light to obtain an improvement of the intensity and contrast of the latent electrostatic image formed on the dielectric surface.

11 Claims, 2 Drawing Figures

CONTRAST OF ELECTROSTATIC LATENT IMAGES WITH A LIGHT FLOODING STEP

BACKGROUND OF THE INVENTION

The well-known TESI (Transfer of Electrostatic Image) system of photoreproduction utilizes the creation of a latent, electrostatic image on a dielectric surface. This image comprises zones of electric charge selectively laid down on the surface of the dielectric sheet. After production of the electrostatic image, the electrostatic image surface is brought into contact with a toner material such as carbon black in combination with an adhesive resin, under such conditions that the toner material adheres to the electrostatically-charged portions of the dielectric surface, and does not adhere to the remaining portions. Accordingly, a visible image is formed on the dielectric surface.

A large amount of research has been invested into the TESI process, as well as other processes involving the creation of an electrostatic latent image on a dielectric surface. Examples of patents relating to this area of technology include: Carlson, et al. U.S. Pat. No. 2,982,647 Schaffert U.S. Pat. No. 3,147,679, Robinson U.S. Pat. No. 3,598,579, and the prior art of record in those patents.

In the TESI process, light is shined through a negative onto a photoconductive electrode. The light-transmitting portions of the negative permit activation of the light-irradiated portions of the photoconductive electrode, causing its electrical resistance to decrease. As a result of this, electrical current can selectively flow through the irradiated portions of the electrode across a small air gap of micronic size, to charge portions of the dielectric surface directly adjacent to the conducting portions of the photoconductive electrode.

In the co-pending U.S. patent application Ser. No. 502,628 of Oleg Szymber, entitled "Means for Improving The Contrast Of An Electrostatic Latent Image", filed simultaneously herewith, it is proposed to apply an electrical potential between the photosensitive electrode and the dielectric surface as a plurality of discrete pulses of similar polarity, separated by time periods in which the applied electrical potential is reduced to essentially zero. In this method, the irradiation of the photoconductive electrode may continue during the time periods of zero applied potential, but the irradiation is only of selected portions of the photoconductive electrode.

In accordance with this invention, significant improvements in the contrast and quality of photocopies made by many latent electrostatic image processes can be achieved by exposing the grounded photoconductive electrode to irradiation over its entire surface in the periods of zero applied electrical potential which follow the discrete pulses of electrical potential.

The effect of this latter irradiation, which is preferably applied as a brief pulse from a strobe lamp or the like while the photoconductive electrode is grounded, is not only to improve the contrast, apparently by removing residual electrical charge from the areas of the photoconductor corresponding to the non-irradiated portions of the photoconductive electrode, but most unexpectedly, it can also create effects which can be used to modify the latent electrostatic image so that the intensity of the resulting visual image created by toning of the electrostatic image may be significantly increased.

This method, with its unexpected results, appears to be directly contrary to previous examples of the use of light to erase latent, electrostatic images, such as in Smith, et al. U.S. Pat. No. 3,776,632; Fujitsuka, et al. U.S. Pat. No. 3,778,148; or Ohta, et al. U.S. Pat. No. 3,697,172.

DESCRIPTION OF THE INVENTION

This invention relates to a method for the contrast enhancement of a latent, electrostatic image on a dielectric surface which comprises: positioning a photoconductive electrode member adjacent the dielectric surface; applying an electrical potential between said photoconductive electrode member and dielectric surface while irradiating selected portions of the photoconductive member, while excluding other portions of the photoconductive member from such irradiation, to cause electrical charge formation on the selected portions of the dielectric surface corresponding to the selected photoconductive member portions. Thereafter, the applied electrical potential is reduced to essentially zero, and the photoconductive member is grounded. In accordance with this invention, the further step is provided of uniformly irradiating, preferably as a pulse of light, the grounded photoconductive member after disconnection of the applied electrical potential to essentially zero, with irradiation which typically is more intense, and preferably at least about 8 to 10 times stronger, in intensity than said irradiation of the selected portions. By this improvement, the intensity and contrast of the electrostatic latent image is increased, so that a more intense visual image, having better contrast, may be formed by conventional toning.

Preferably, the electrical potential is applied as a plurality of discrete pulses which are separated by time periods in which the applied electrical potential is returned to essentially zero, for example by grounding, and which have an average duration of at least the average duration of the pulses. The uniform irradiation of the photoconductive member is applied during the time periods which separate the pulses of potential.

While not wishing to be limited to any particular theory of operation of the invention of this application, it is believed that the uniform irradiation of the photoconductive electrode permits residual charge in it to bleed off through the bulk of the photoconductive electrode. It is, however, not clearly understood why this process increases the density of the resulting toned image.

Preferably, essentially all of the pulses of applied electrical potential each have a duration of 5 to 200 milliseconds, and the time periods of essentially zero applied electrical potential each preferably have a duration of at least twice the duration of a pulse of electrical potential.

Typically, the pulse of electrical potential has a maximum potential of 500 to 800 volts, particularly under circumstances in which the major portion of the area of the photoconductive member is spaced from the dielectric surface by 5 to 20 microns to provide an air gap therebetween. This is generally done by the use of selectively roughened paper, which serves as a combination image-receiving dielectric surface, which provides intermittent spacing by the peaks of roughness on the paper itself. Such paper is well-known to the art and is available from the Weyerhauser Company as Type M dielectric-coated paper. One other type of such paper is described in U.S. Pat. No. 3,519,819.

The uniform irradiation of the photoconductive member is performed while the photoconductive member is grounded in any conventional manner, but as shown herein, the grounding may preferably be accomplished by connecting both the photoconductive member and dielectric surface together in communication with the same terminal of the source of electrical potential.

As shown in the specific embodiment below, the uniform irradiation may be provided by a strobe flash lamp, which is powered by a capacitor to provide an energy flux of about 1 to 2 microwatt-seconds per pulse per square centimeter of the photoconductor. The irradiation from the tungsten lamp which irradiates selected portions of the photoconductive member provides from 0.1 to 0.2, e.g., about 0.14 microwatt-seconds of energy flux per pulse of electrical potential per square centimeter of photoconductor, although the tungsten lamp irradiation may be continuous. Accordingly, it can be seen that in the specific embodiment shown herein, the intensity of a pulse of uniform irradiation provided after bringing the applied electrical potential to zero may preferably be about 8 to 10 times that of the selective irradiation.

Preferably, each of the pulses of applied electrical potential selectively applied to the photoconductor have a duration of about 20 to 100 milliseconds, and the time periods of zero applied potential each are about 200 to 400 milliseconds in duration. Therefore, a desirable pulse may have a duration of 20 to 100 milliseconds, with a time period of zero applied potential between pulses being about 200 to 300 milliseconds. Preferably, at least four of said pulses are applied.

Another set of process conditions which yield excellent results, but which may excessively be long in duration for some commercial purposes, involves a series of about 5 to 10 pulses of applied electrical potential selectively applied to the photoconductive electrode, each pulse having a duration of only about 10 milliseconds each, separated by periods of essentially zero applied potential of 100 to 200 milliseconds, during which time the uniform irradiation or illumination is applied.

Referring to the drawings.

Figure 1:
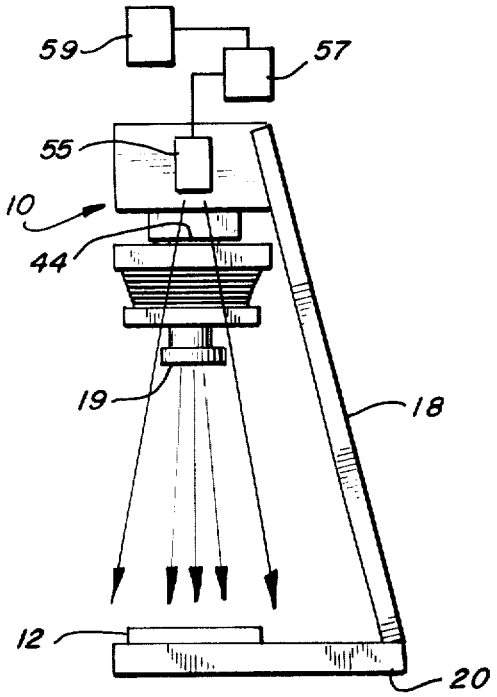
FIG. 1 is a schematic view of apparatus for performing the method of this application in conjunction with a TESI process.
Figure 2:
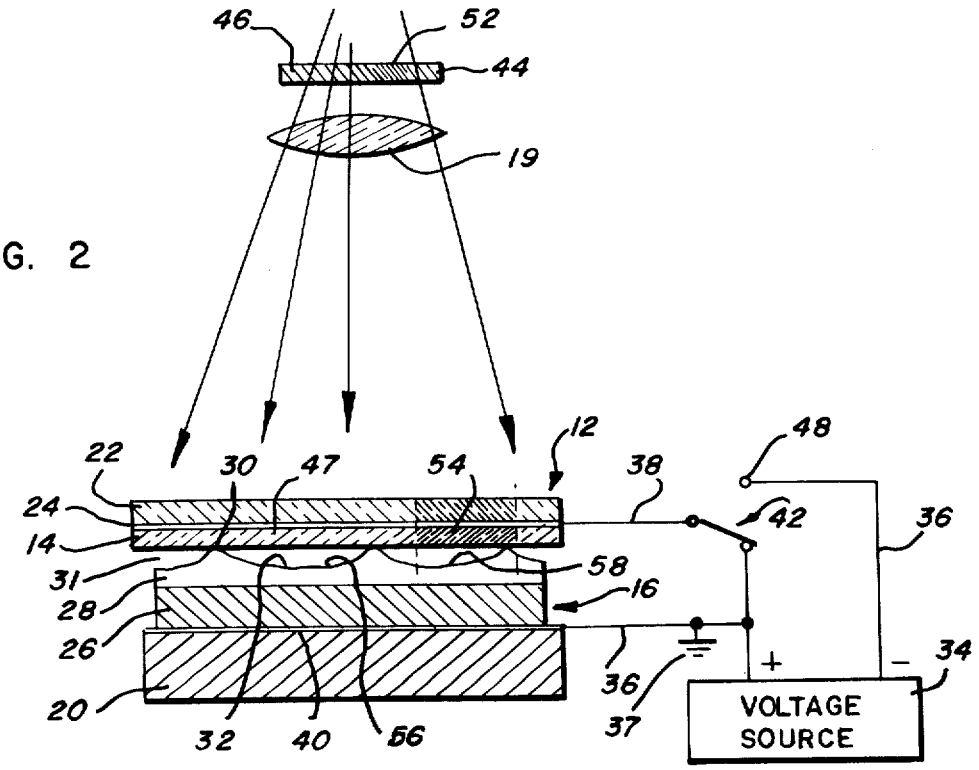
FIG. 2 is a schematic, sectional view, greatly enlarged, of the dielectric member, the photoconductive electrode, and associated parts.

Referring to FIGS. 1 and 2, the overall apparatus of this invention is shown schematically, including a focusing light source 10 for illuminating stack 12, which includes photoconductive electrode 14, and dielectric sheet 16.

Light source 10 is positioned over stack 12 by a support 18, which is attached to a stand 20 upon which stack 12 rests. Lens 19 provides focused light, which has passed through a negative, as described below.

Referring in particular to FIG. 2, a greatly magnified, schematic view of stack 12 is shown. Photoconductor 14 may be made in accordance with Canadian Patent No. 891,424, and constitutes a plate which may be attached to a glass or a clear plastic layer 22 through transparent, conductive layer 24. Transparent conductive layer 24 may be manufactured in accordance with U.S. Pat. No. 3,674,711 or may comprise a fused tin oxide sold under the trademark NESA by the Pittsburgh Plate Glass Company.

Dielectric sheeting 16 is shown in this embodiment to include a paper layer 26, which is coated on its upper side with a dielectric layer 28, about 5 microns in thickness. The dielectric material may be pigmented polyvinyl butyral, such as Butvar 72A of Varian Associates, containing pigments such as barium oxide, zinc oxide, and silicon dioxide. Alternatively, the polyvinyl butyral resin may be replaced in whole or in part with polyvinyl acetate resin, containing similar pigments.

Preferably, the dielectric layer is slightly roughened to define peaks 30, which provide an air gap 31 spacing for most of the dielectric sheeting surface 32 from the underside of the photoconductor 14. Peaks 30 may be about 7 microns high to space sheeting 16 from photoconductive electrode 14, and to provide an air gap of that thickness. Generally, air gap 31 is no larger than 15 to 20 microns, and may be as small, on the average, as about 5 microns.

A voltage source 34 is adapted to provide a D.C. potential through conductor lines 36, 38 between transparent conductor 24, and dielectric sheeting 16 through conductor sheet 40, which may overlie base 20, upon which dielectric sheeting 16 rests. A line 36 is connected to ground 37. Any appropriate switching means 42 may be provided, to permit the selective application of direct current voltage between photoconductor 14 via transparent conductor 24, and dielectric sheeting 16, and also to permit "shorting out" or grounding of said pulses of voltage for the desired time period. A switch such as a Type "C" relay switch with a Hewlett-Packard pulse generator has been found to be suitable for use herein.

A transparent image negative 44 is mounted in light source 10 between the light source and lens 19, to project a focused image on stack 12. The negative 44 contains the image which is desired to be reproduced.

Accordingly, light 10 (typically using a quartz-lined, 150-watt bulb with a 24 volt filament and a 4-96 filter sold by the Corning Glass Company as a light source), is illuminated to irradiate negative 44. Some portions 46 of negative 44 are clear and light-transmitting, so that the light passes through transparent glass or plastic layer 22 and transparent conductor 24, to irradiate some portions 47 of photoconductor 14. Other portions 52 of negative 44 are light-reflecting or absorbing, so that corresponding portions 54 of photoconductor 14 are not irradiated.

For preparation of an electrostatic image, switch 42 is closed against terminal 48, to provide a pulse of electrical potential across air gap 31. In the irradiated portions 47 of photoconductor 14, the electrical resistance through such irradiated portion 47 drops sufficiently to quickly permit voltage source 34 to impart an electrical potential across air gap 31 which reaches its Paschen breakdown voltage. A "Paschen breakdown voltage" is the minimum voltage necessary to permit electric charge to be transferred across air gap 31 from photoconductor 14 to dielectric layer 28. Under the conditions specified above, the Paschen breakdown voltage of the specific embodiment shown herein is about 350 volts, while voltage source 34 provides approximately 650 volts to the circuit. Accordingly, in the illuminated or irradiated areas 47 of photoconductor 14, charge will transfer across air gap 31 with each pulse of voltage provided limited by saturation levels of the dielectric.

Corresponding to the dark, light-absorbing portions 52 of negative 44, the non-illuminated portions of areas 54 of photoconductor 14 retain a high resistance. Accordingly, because of the additional resistance, the voltage build-up across air gap 31 adjacent non-illuminated areas 54 of the photoconductive electrode proceeds at a much slower rate. Accordingly, the voltage of source 34, and each pulse time, is adjusted to provide a condition of charge flow from the illuminated areas of the photoconductive electrode, while minimizing or eliminating the flow of charge from non-illuminated areas 54 of electrode 14.

Accordingly, an electrostatic image may be formed in which charge is laid down on selected portions 56 of dielectric surface 28, corresponding to irradiated photoconductive member portions 47, while little or no charge is transmitted to the areas 58 of the dielectric surface corresponding to non-illuminated areas 54 of the photoconductive member.

Strobe flash lamp 55 may be of a commercially available type, and is appropriately positioned to uniformly illuminate the entire surface of stack 12 with a pulse of light having a duration in the microsecond range, providing a light energy flux of about 2 microwatt·seconds per sq. cm. per pulse to the surface of electrode 14. Generally, a considerable range of time of exposure of the uniform irradiation can be used. However, due to photoconductor memory effect, an excessive exposure to the uniform irradiation, and particularly to irradiation of excessively high intensity for the particular experimental conditions selected, may result in an uneven latent electrostatic image, which, upon toning, will result in a "blotchy" appearance both of the image and the background areas.

Strobe light 55 is electrically connected to a condenser 57 for powering the strobe light. This apparatus in turn may be synchronized by switch and time delay (typically about 10 milliseconds) unit 59 to cause condenser 57 to discharge in predetermined time relation to the operation of switch 42, so that condenser 57 discharges during each zero applied potential period.

Describing in detail the process of this invention, an exemplary series of four or more 40-millisecond pulses of applied potential (caused by closing switch 42) are separated by 200 millisecond periods of zero applied potential (caused by opening switch 42 to the position shown in FIG. 2).

During the first 40-millisecond period, switch 42 is placed in the closed position to provide a 650-volt potential across the system. The voltage between illuminated areas 47 and surface 56 rises much more rapidly than the voltage between non-illuminated areas 54 and surface 58, as a result of the decreased resistance of the illuminated areas 47 of photoconductor 14. When the potential or voltage adjacent the illuminated areas 47 reaches about 350 volts, the voltage ceases to rise, since the Paschen breakdown voltage has been achieved, and the current flows across air gap 31 to charge adjacent portions 56 of dielectric surface 28.

During the first 40-millisecond pulse, the voltage across air gap 31 adjacent the non-illuminated areas 54 of photoconductor 14 also rises, but relatively slowly, due to the high resistance of non-illuminated areas 54. However, before the Paschen breakdown voltage is reached by non-illuminated areas 54, the applied electrical potential is reduced to zero by switch 42 (at the end of the 40-millisecond period), which causes a drop of the voltages across air gap 31 during the first 200-millisecond period of zero applied potential. After this 200-millisecond period has elapsed, the voltages across air gap 31 are reduced, without permitting current flow across the air gap 31 adjacent areas 54. Thereafter, a second pulse of D.C. voltage is applied to the system for a second 40-millisecond period.

Once again, during this period, the voltage across air gap 31 adjacent illuminated areas 47 rises more quickly than the corresponding voltage across non-illuminated areas 54, so that the Paschen voltage is reached by areas 47, and another pulse of electric current passes across air gap 31 to dielectric surface 56.

At the end of the second 40-millisecond time period, another 200-millisecond time period of zero applied electrical potential is provided, to permit the respective voltages to once again drop.

A third 40-millisecond period of electrical potential, and a third subsequent period of zero applied potential of 200-milliseconds duration can be applied, and the above series of applied pulses can be repeated as many times as desired, preferably at least 4 times.

As a result of the above pulsed pattern of application of electric charge, it can be seen that a series of charge pulses are transferred across air gap 31 without any charge in significant amount being transferred from non-illuminated portions 54 of photoconductive member 14.

During each 200-millisecond period of zero applied potential, lamp 55 is fired to provide a pulse of illumination across the entire surface of photoconductive electrode 14. Strobe lamp 55 does not shine through negative 44, so portions 54 of photoconductive electrode 14 receive the same amount of irradiation as areas 47. During this period, both photoconductive electrode 14 and dielectric sheeting 16 are grounded together at the positive terminal of the voltage source 34. Accordingly, a certain amount of residual charge is capable of migrating, due to the momentary reduced resistance of photoconductive electrode 14 caused by strobe lamp 55.

Residual charge from photoconductor 14 tends to dissipate, which results in a clearer, whiter background area on the dielectric surface after the resulting electrostatic image has been toned.

Areas 56 appear, for an unknown reason, to gain electric charge. The resulting toned image, therefore, shows a darkening of the toned areas when a preferred method of this application is practiced. As a result, the dark areas of photocopies prepared in accordance with this invention tend to be darker, while the light areas remain light, thus providing increased contrast, particularly when the negative 44 or other equivalent image producing member has a low contrast.

The above has been offered for illustrative purposes only, and is not to be considered as limiting the invention of this application, which is as defined in the claims below.

That which is claimed is:

1. In a method for the contrast enhancement of an electrostatic latent image on a dielectric surface which comprises: positioning a photoconductive member adjacent said dielectric surface in a manner forming an air gap therebetween, applying an electrical potential between said photoconductive member and said dielectric surface, irradiating selected portions of said photoconductive member while excluding other portions of the photoconductive member from said irradiation, whereby electric charge is caused to form on selected portions of said dielectric surface corresponding to said irradiated photoconductive member portions as a result of charge transfer between said photoconductive member and said dielectric when the voltage drop across said air gap bounded by facing surfaces of said photoconductive member and said dielectric exceeds a predetermined minimum value, said electrical potential being applied as a plurality of discrete pulses of similar polarity, said pulses being of a duration such that said voltage drop across said air gap will exceed said predetermined minimum value in the selected irradiated portions of said photoconductor and will be below said predetermined minimum value in said excluded portions thereof, said pulses of electrical potential being separated by time periods in which said applied electrical potential is essentially zero, said time periods having an average duration of at least the average duration of said applied pulses so that the relative density of electric charge in said selected portions of the dielectric surface is increased by said plurality of pulses over any electric charge density in the non-irradiated portions thereof, the improvement comprising: grounding and uniformly irradiating said photoconductive member during each said time period of essentially zero applied potential which separate said pulses, whereby the intensity and contrast of the electrostatic latent image thus formed is increased, said uniform irradiation being of greater intensity than said irradiation of the selected portions.

2. The method of claim 1 in which essentially all of said pulses of applied electrical potential each have a duration of 5 to 200 milliseconds.

3. The method of claim 2 in which essentially all of said time periods of zero applied electrical potential each have a duration of at least 2 times the duration of said pulses.

4. The method of claim 3 in which the intensity of said uniform irradiation is 8 to 10 times the intensity of said irradiation of said selected portions.

5. The method of claim 3 in which the major portion of the area of said photoconductive member is spaced from said dielectric surface by 5 to 20 microns, to provide an air gap therebetween.

6. The method of claim 5 in which said pulse of electrical potential has a maximum potential of 500 to 800 volts.

7. The method of claim 6 in which said irradiation of the selected portions is provided by visible light providing an energy flux of 0.1 to 0.2 microwatt·second per square centimeter at said photoconductive electrode surface during each pulse of electrical potential, and said uniform irradiation provides an energy flux of 1 to 2 microwatt·seconds per square centimeter at said photoconductive electrode surface.

8. The method of claim 7 in which each said pulse of potential has a duration of about 40 milliseconds, said time periods of zero applied potential have a duration of about 200 milliseconds; and each said uniform irradiation applied during the time period of zero applied potential constitutes a pulse of visible light, each said pulse of light having an energy flux at said photoconductive electrode surface of about 1.4 microwatt·seconds per square centimeter.

9. The method of claim 8 in which at least four of said pulses of electrical potential are applied and a separate pulse of irradiation is applied during each said time period of zero applied potential.

10. The method of claim 9 in which said selected portions of the photoconductive member are irradiated by passing irradiating light through a low contrast negative.

11. The method of claim 1 in which said irradiation of the selected portions is provided by visible light providing an energy flux of 0.1 to 0.2 microwatt·second per square centimeter at said photoconductive electrode surface during each pulse of electrical potential, and said uniform irradiation provides an energy flux of 1 to 2 microwatt·seconds per square centimeter at said photoconductive electrode surface.

* * * * *